US007401485B2

(12) United States Patent
Peter et al.

(10) Patent No.: US 7,401,485 B2
(45) Date of Patent: Jul. 22, 2008

(54) APPARATUS FOR INSPECTING STEEL STRIP DURING ROLLING

(75) Inventors: Martin Peter, Siegen (DE); Rudolf Hofheinz, Hilchenbach (DE); Alfons Baumhoff, Kirchhundem (DE)

(73) Assignee: SMS Demag Aktiengesellschaft, Dusseldorf (DE)

( * ) Notice: Subject to any disclaimer, the term of this patent is extended or adjusted under 35 U.S.C. 154(b) by 346 days.

(21) Appl. No.: 10/537,202

(22) PCT Filed: Dec. 29, 2003

(86) PCT No.: PCT/EP03/14938

§ 371 (c)(1),
(2), (4) Date: Jun. 2, 2005

(87) PCT Pub. No.: WO2004/060589

PCT Pub. Date: Jul. 22, 2004

(65) Prior Publication Data

US 2006/0053860 A1 Mar. 16, 2006

(30) Foreign Application Priority Data

Jan. 6, 2003 (DE) ..... 103 00 362

(51) Int. Cl.
*B21B 23/00* (2006.01)
*B21B 38/00* (2006.01)
*B21C 47/00* (2006.01)

(52) U.S. Cl. ..... 72/148; 72/203; 72/146; 72/227; 72/250; 242/535.1; 242/474.3; 242/362.1

(58) Field of Classification Search ..... 72/148, 72/31.07, 365.2, 366.2, 203, 204, 206, 227, 72/250, 251, 146, 228; 242/362.1, 474.3, 242/535.1

See application file for complete search history.

(56) References Cited

U.S. PATENT DOCUMENTS

| | | | | | |
|---|---|---|---|---|---|
| 1,474,319 | A | | 11/1923 | Crosby | |
| 2,325,559 | A | * | 7/1943 | Washam, Jr. | 72/148 |
| 3,240,043 | A | * | 3/1966 | Sieger | 72/148 |
| 3,841,131 | A | * | 10/1974 | Gross et al. | 72/148 |
| 4,296,623 | A | * | 10/1981 | Eibe | 72/227 |

(Continued)

FOREIGN PATENT DOCUMENTS

| | | |
|---|---|---|
| EP | 0 497 182 | 8/1982 |

(Continued)

*Primary Examiner*—Dmitry Suhol
(74) *Attorney, Agent, or Firm*—Andrew Wilford

(57) ABSTRACT

Steel strip issues continuously from a downstream end of a rolling line and can be wound up there on a coiler. An inspection table downstream of the rolling line has a surface aligned with the downstream end and the strip emerging therefrom. The coiler is below a plane of the table surface. During normal rolling the strip is deflected downward to the coiler and reeled up. For inspection of the strip, the strip is cut transversely to produce a new leading end and is fed starting at this end toward the table without substantial deflection. Then the strip is cut again upstream of the new leading end to form a strip sample separate from the strip emerging from the rolling line, which sample is fed to the table and arrested and inspected while strip emerging from the line is deflected back down to the coiler to continue coiling it up.

7 Claims, 3 Drawing Sheets

U.S. PATENT DOCUMENTS

| | | | | |
|---|---|---|---|---|
| 4,549,700 | A | 10/1985 | Ganseuer | |
| 5,335,713 | A * | 8/1994 | Hoppmann et al. | 164/441 |
| 5,535,610 | A * | 7/1996 | Noe et al. | 72/8.6 |
| 6,502,445 | B1 * | 1/2003 | Drigani et al. | 72/148 |

FOREIGN PATENT DOCUMENTS

| | | |
|---|---|---|
| EP | 0 812 634 | 12/1997 |

* cited by examiner

APPARATUS FOR INSPECTING STEEL STRIP DURING ROLLING

CROSS REFERENCE TO RELATED APPLICATIONS

This application is the US national phase of PCT application PCT/EP2003/014938 filed 29 Dec. 2003 with a claim to the priority of German patent application 10300362.2 itself filed 6 Jan. 2003, whose entire disclosures are herewith incorporated by reference.

FIELD OF THE INVENTION

The invention relates to a method of rolling and then winding into coils, metallic strip, especially steel strip, on at least one rotatably driven, spreadable winding mandrel or reel core, where the metal strip is inspected in longitudinal segments for rolling anomalies.

BACKGROUND OF THE INVENTION

In practice a carousel strip coiler, reeler or winder with a separate inspection line is known. The steel strip outputted by the rolling mill line is wound into coils. For inspection of the strip it is necessary to remove an entire coil from the material flow path and to inspect the strip of that coil for rolling defects. These inspections are extremely time consuming and disadvantageous from the point of view of the economics. For one thing there is only a limited accessibility and, for another thing, there is a delay in discovering the origin of the rolling anomalies. There is also a significant time loss in that the production can continue with the defects.

Carousel coilers with paired winding mandrels or cores are known (EP 0 812 634 B1; U.S. Pat. No. 5,904,313). Such constructions are not, however, directly associated with an inspection line.

In a further carousel coiler with two coiling mandrels or cores (EP 1 039 970 B1; WO 1998/035756) a specific construction of the drive for the coiler mandrels or cores has been proposed.

Another construction of a carousel coiler with two coiler mandrels or cores (EP 0 773 178 B1; U.S. Pat. No. 5,921,498) also relates to the configuration of the drive for the coiler mandrels or cores, so that here as well the provision of an inspection line for the coiling station has not been considered.

OBJECT OF THE INVENTION

The invention sets out, as its object, to provide a method of rolling and then coiling metal strip, especially steel strip, and an apparatus which will allow economical and rapid inspection of strip samples in the framework of a continuous rolling process.

SUMMARY OF THE INVENTION

The presented object is achieved in accordance with the invention in that the strip sample is guided within the rolling line "in line" over a deeper-lying coiling station onto an inspection table for a free perusal and is stopped. This provides significant advantages over a separate inspection process outside the rolling line: Upon an inspection cut, a sheet-metal tablet is advanced directly onto the inspection table so that defect sources of the rolling process can be more rapidly recognized. In addition only a sample of the strip is required in the form of the sheet-metal tablet and not an entire coil diverted from the material flow. As a result a short access time is afforded for the rapid inspection to be carried out. The investment in an additional inspection coil and in a carriage for shifting a coil out of the material flow can thereby be saved.

An embodiment or one configuration of the invention has a belt conveyor which can brake the strip samples and is integrated in the inspection table.

It has been found to be especially advantageous to swing the strip coiled on the upper cooling mandrel or core during the continuous rolling operation through 180° and to coil it to a predetermined maximum finished coil diameter.

The manipulation of finished coils can thus be improved in that the coil formed on the lower coiling mandrel or core can be lowered downwardly and displaced out parallel to the coiling mandrel or core axis. Thus the wound coil can be lowered directly via a wound coil lifting device.

The aspect of the invention which concerns the apparatus starts from an apparatus for rolling and then coiling metal strip, especially steel strip which is equipped, downstream of a rolling line, with an inspection device which is connected to the last rolling mill stand for inspection of the metal strip for rolling anomalies.

The objects which have been set forth are achieved from an apparatus view point and in accordance with the invention in that the coiling station is located below the plane of an inspection table disposed "in line" with the rolling line and upon which a strip sample can be freely viewed or perused (inspected). The steel strip emerging from the last rolling mill stand can be so guided that at the inlet to the coiling station, a deflecting unit is provided for deflecting the metal strip to at least one coiling mandrel or core.

The metal strip can be divided such that a residual length remains upon the two coiling mandrels or cores when, in accordance with a further feature of the invention, the coiling station is formed by respective upper and lower coiling mandrels arranged eccentrically within respective rotary frames below the plane of the inspection table.

To be able to switch over the coiling mandrel through 180°, the upper coiling mandrel and the lower coiling mandrel can lie diametrically opposite one another across the central axis of the rotary frame and can be swung through 180° about this axis.

As tests have shown it is especially advantageous for the diameter to lie at an angle to the horizontal of about 15° to 25°.

The 180° rotation can be produced by mounting the rotary frame for the coiling mandrels upon rotatably driven support rollers.

Furthermore, the winding of the strip onto the lower coiling mandrel can be further improved if the lower coiling mandrel is juxtaposed with a pressure roller arm capable of being swung in or out and provided with a pressure roller.

BRIEF DESCRIPTION OF THE DRAWING

In the drawing an embodiment of the invention has been shown which will be described in greater detail hereinafter. The drawing shows.

SPECIFIC DESCRIPTION

Figure 1:
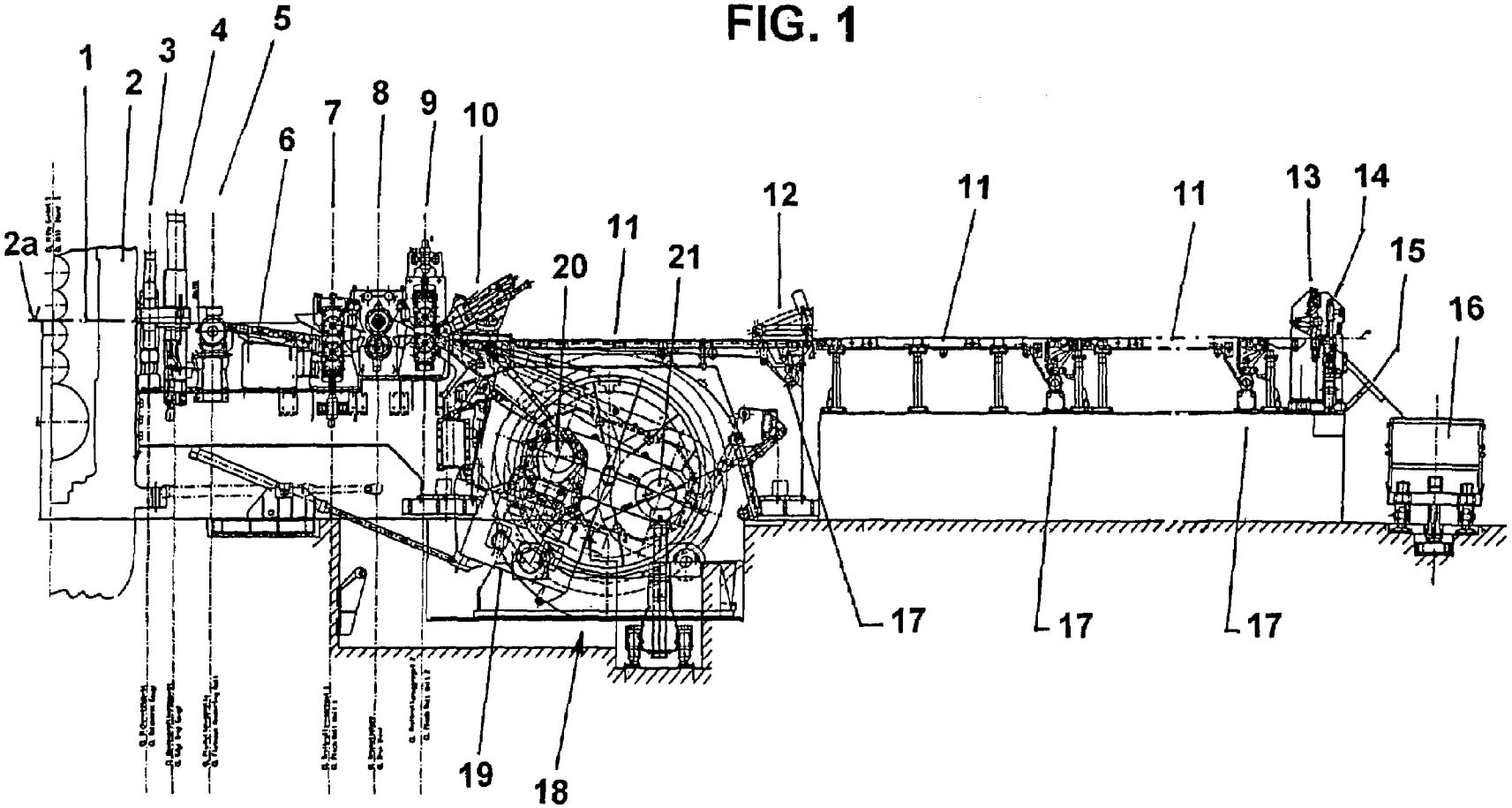
FIG. 1 a side view of the coiling station with the inspection line.

In a rolling line, like for example a Conti-rolling line, metal strip 1, especially steel strip 1, downstream of the last rolling mill stand 2 of the rolling line 2*a*, based upon strip samples 1*a* of several meters in length, is inspected for deviations (anomalies), for example in the surface, the geometry, for thickness differences, for corrugations or waviness or the like. The outlet device arranged for this purpose is comprised of a series of a thickness measuring device 3, an edge profile measuring device 4, a planarity measurement roller 5 and a guide table 6, a first drive roller unit 7, a drum shear 8 for cutting the strip sample 1*a* from the continuous strip, a second drive roller unit 9 and a deflecting unit 10. The rolling line 2*a* continues onto an inspection table 11. As soon as the drum shear 8 receives signals to effect a cutting operation, the sample 1*a* on an "inline" basis within the rolling line 2*a* is caused to move above the lower lying coiling station 18 onto the inspection table 11 and is stopped there by a strip stopping device 12 for a free viewing or visual inspection. The strip sample 1*a* is thus braked by a belt conveyor 17 which is integrated in the inspection tables 11 which follow one another.

In a further advance, the strip sample 1*a* is transported off by means of a third drive roller unit 13 to a shear 17 that chops it into pieces that are dumped via a chute 15 into a scrap wagon 16. The transport drive for the strip samples is a belt conveyor 17. As a safety factor during the strip inspection, the strip stop device 12 can be swung out of the way.

Figure 2:
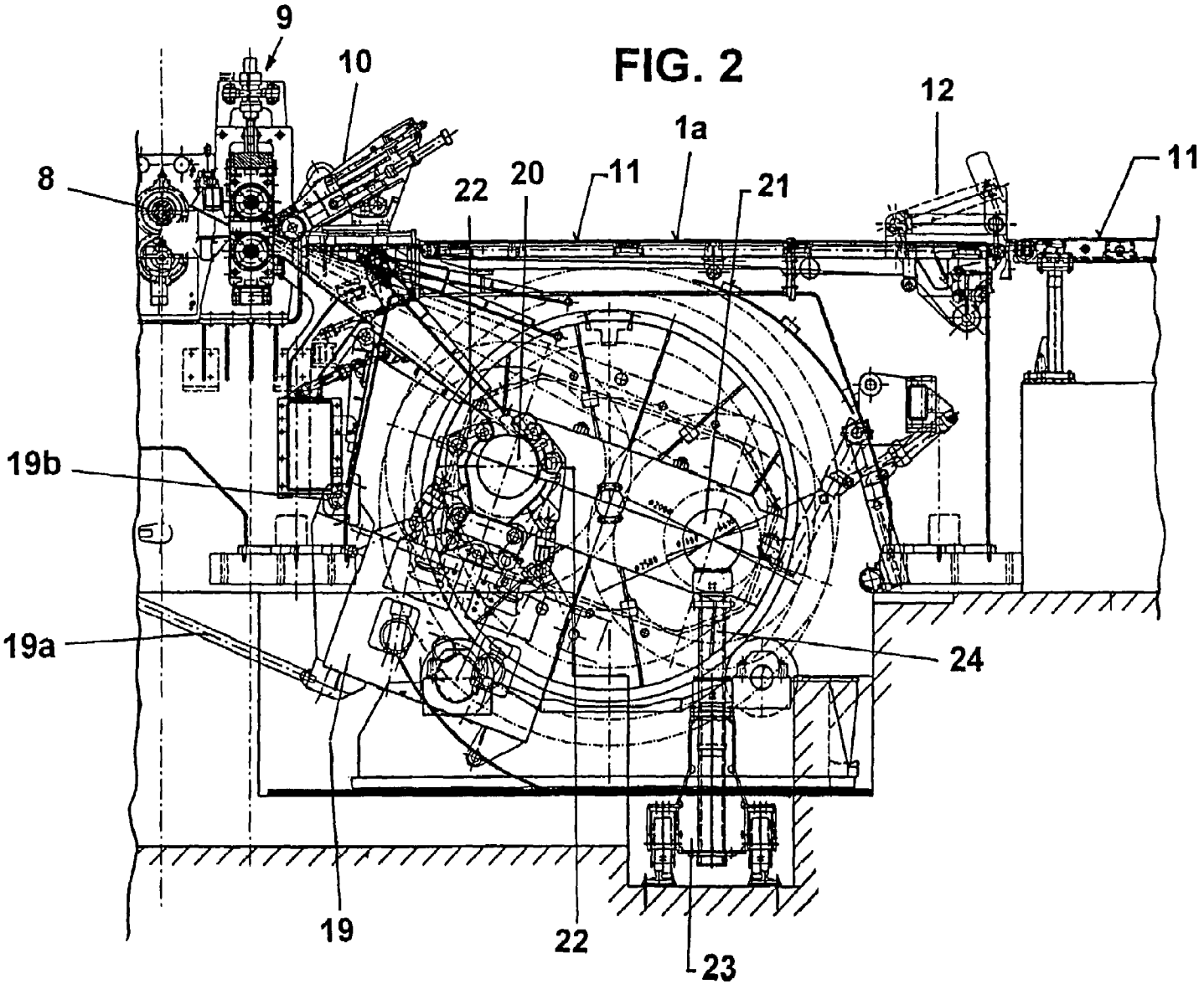
FIG. 2 the same side view of the coiling station with the inspection table drawn to a larger scale and FIG. 3 a further enlarged illustration of the coiling station.

In FIG. 2 the coiling station 18 has been shown to larger scale. It has a strip coiling pivotal frame 19 which is swingable about a pivot axis 19*b* by means of a separate hydraulic pivotal line 19*a*. In the coiling station 18 an upper coiling mandrel or core 20 and a lower coiling mandrel or core 21 are mounted for rotation by respective drives. The upper coiler mandrel 20 is embraced by two strip coiler arms 22. The strip coiler arms 22 can be swung into or out of position by a hydraulic strip coiler arm pivot drive 26 (see FIG. 3 as well).

After the strip sample 1*a* has been cut from the oncoming continuous strip, the new strip edge is deflected downwardly by means of the deflection unit 10 and is guided beneath the inspection table 11 and guided onto the upper coil mandrel 20 or the coiling mandrel 21 for winding thereon. The rolling process is not interrupted by cutting the sample strip segment from the oncoming strip.

A coil 25 wound on the upper coiling mandrel 20 is swung through 180° during the continuous rolling operation and is wound to a predetermined coiled diameter 25*a*. The wound coil 25 on the lower coiling mandrel 21 is lowered by a wound coil lifting unit 24 and transported off on a wound coil removal carry 23 parallel to the coiler mandrel axis.

Figure 3:
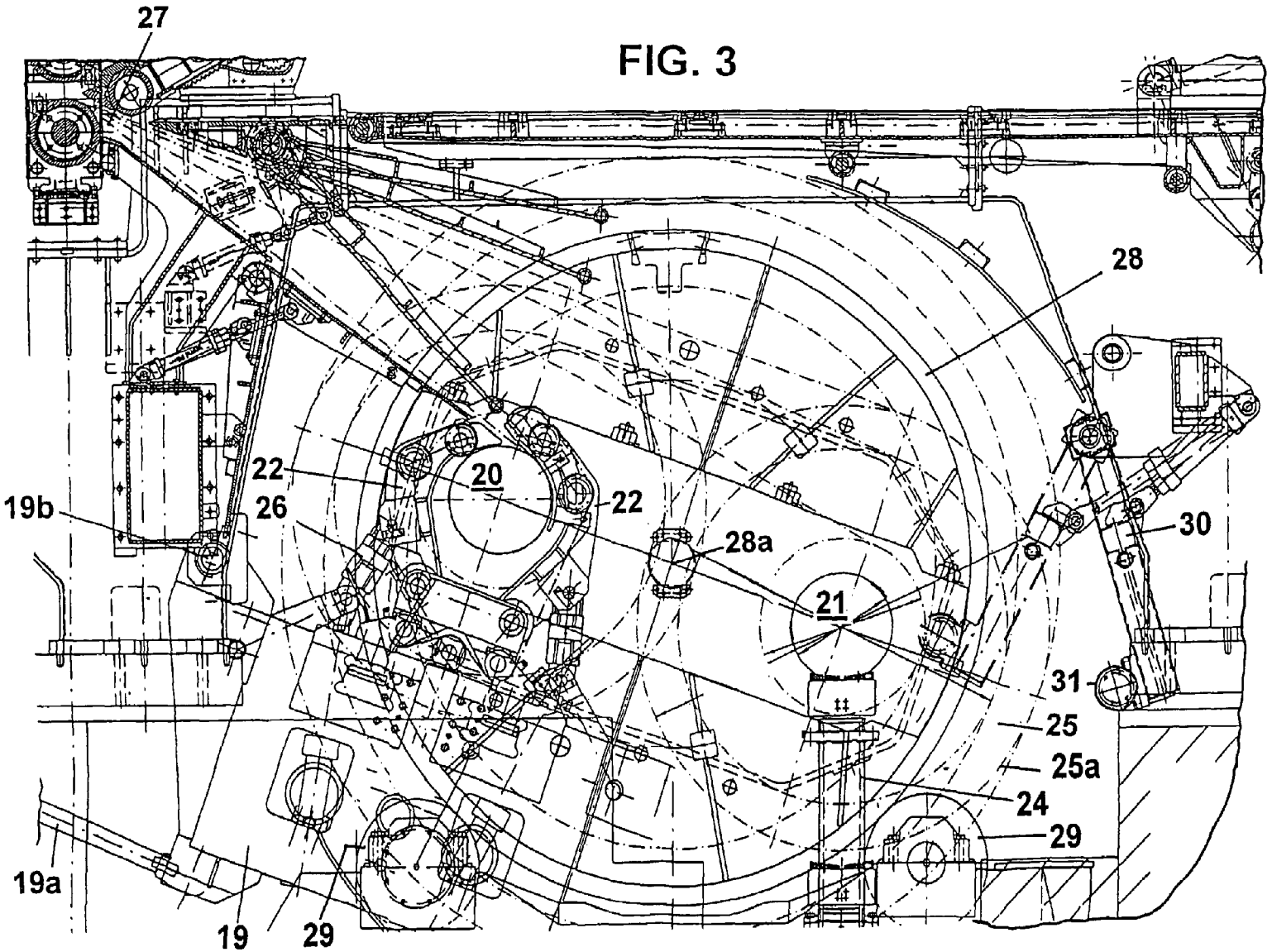

In FIG. 2 or FIG. 3 it has been shown further that at the inlet 27 to the coiler station 18, the deflection unit 10 can bend the metal strip 1 out of the rolling line 2*a* at a desired angle to the coiling mandrel 20 and/or 21. Externally of the strip coiler pivot frame 19, the coiler section 18 is provided with a rotary frame 28 in which the coiler mandrels 20 and 21 are rotatably journaled and driven. The coiler mandrels 20 and 21 lie eccentrically to the central axis 28*a* of the rotatable frame 28 at the same spacing along a diameter from the pivot axis 28*a* of the frame 28. The rotatable frame 28 is supported on support rollers 29 which are rotatable driven. The diameter along which the mandrels 20 and 21*a* disposed includes an angle of about 15° to 25° with the horizontal.

A wound coil 25 (FIG. 3) can be wound to a maximum coil diameter 25*a*. In the region of the layer coiler mandrel 21, the housing of the coiler station has a pivotable pressure roller arm which, at its front end, carries a pressing roller 31. The pressing roller arm 30 can be swung back and forth from its rest position indicated by thicker solid lines into a working position, indicated by thinner broken lines.

The invention claimed is:

1. An apparatus for producing, coiling, and inspecting steel strip in a mill where the strip issues continuously in a travel direction from a downstream end of a rolling line and can be wound up there on a coiler, the apparatus comprising:

an inspection table downstream of the rolling line with a planar support surface of the table aligned with the downstream end of the rolling line and the strip emerging therefrom, the coiler being oriented below a plane of the table support surface;

means for transversely cutting the strip upstream of the coiler and downstream of the downstream end of the rolling line;

means connected to the coiler and to the cutting means for normal rolling deflecting the strip downward to the coiler and reeling the strip up on the coiler; and inspection of the strip transversely cutting the strip to produce a new leading end, feeding the strip starting at the new leading end toward the table without substantial deflection, transversely cutting the strip upstream of the new leading end to form a strip sample separate from the strip emerging from the rolling line conducting the strip sample to the table and arresting and inspecting the strip sample on the table surface while deflecting the strip emerging from the line back down to the coiler to continue coiling it up.

2. The apparatus according to claim 1, further comprising at an inlet to the coiler at least one coiling mandrel.

3. The apparatus according to claim 1 wherein the coiler has an upper coiling mandrel and lower coiling mandrel arranged eccentrically within a rotating frame below the plane of the inspection table.

4. The apparatus according to claim 3 wherein the upper coil mandrel and the lower coil mandrel lie on a diameter through a rotation axis of the rotating frame.

5. The apparatus according to claim 4 wherein the diameter runs at an angle to the horizontal of about 15° to 25°.

6. The apparatus according to claim 3 wherein the rotating frame for the coiling mandrels is journaled for rotation on rotatably driven support rollers.

7. The apparatus according to claim 3 wherein the lower coiling mandrel has juxtaposed with it a pressing roller arm swingable in and out and provided with a pressing roller.

* * * * *